United States Patent [19]

Mayer

[11] 4,050,627

[45] Sept. 27, 1977

[54] ADJUSTABLE HEAT RECOVERY SYSTEM FOR FLUE STACKS

[75] Inventor: Joseph E. Mayer, Minnetonka, Minn.

[73] Assignee: Kimball of Minnesota, Inc., Minneapolis, Minn.

[21] Appl. No.: 716,186

[22] Filed: Aug. 20, 1976

[51] Int. Cl.[2] ..... F24B 7/04

[52] U.S. Cl. ..... 237/55; 138/38; 126/122; 165/35; 165/102; 165/103; 165/DIG. 2

[58] Field of Search ..... 237/55; 165/102, 103, 165/DIG. 2, 96, 128, 35; 126/110 R, 122, 117, 102; 138/38, 39, 46

[56] References Cited

U.S. PATENT DOCUMENTS

| | | | |
|---|---|---|---|
| 442,846 | 12/1890 | Whitting | 165/103 |
| 525,896 | 9/1894 | Grennell | 165/DIG. 2 |
| 2,343,542 | 3/1944 | Faunce | 165/103 |
| 3,298,599 | 1/1967 | Dayton | 138/39 |
| 3,650,318 | 3/1972 | Avery | 165/35 |
| 3,760,870 | 9/1973 | Guetthuber | 165/35 |
| 3,813,039 | 5/1974 | Wells | 237/55 |

*Primary Examiner*—William F. O'Dea
*Assistant Examiner*—Henry C. Yuen
*Attorney, Agent, or Firm*—Orrin M. Haugen

[57] ABSTRACT

Heat exchange means for use in combination with flue means conducting heated gases from a combustion zone and for extraction of thermal energy from the heated gases. A casing means is provided defining an enclosure with a central axis, and having fresh air chambers at opposed ends of the casing, and with a heat exchange chamber disposed between the fresh air chambers. Heat exchange conduits couple the opposed fresh air chambers, with the heat exchange conduits extending through the heat exchange chamber about an annular zone spaced outwardly from the central axis. A pair of baffle plates are provided within the heat exchange chamber, with the plates being arranged at opposed ends of the chamber, and with one baffle plate being movable axially. The controllable positioning of the movable baffle plate defines the axial length of the heat exchange conduits exposed to heated flue gases moving through the heat exchange chamber.

4 Claims, 7 Drawing Figures

ADJUSTABLE HEAT RECOVERY SYSTEM FOR FLUE STACKS

BACKGROUND OF THE INVENTION

The present invention relates generally to heat exchange apparatus for use in combination with flue means conducting heated gases from a combustion zone, and more specifically to such a heat exchange means which is provided with internal baffling so as to control the amount of energy extracted from the heated gases.

In the past, heat exchange systems have been proposed for use in combination with flue means conducting heated gases from combustion zones. The fundamental purpose of the devices or systems is to extract thermal energy from stack gases, normally stack gases which carry products of combustion from a heating furnace or the like. Furnaces for residential dwellings are normally designed for use with conventional fuels, such as natural gas, fuel oil, or the like. The stacks or flues for these furnaces are designed to operate at a certain temperature level which is sufficiently high so as to prevent any unusual build-up or accumulation of condensate from the products of combustion.

In the conventional fuels, water is one of the primary products of combustion, and in order to prevent condensation build-up or freezing of the water, the stack temperature must be maintained at a sufficiently high level. Furthermore, elevated stack temperatures are required for controlling the movement of products of combustion through the system.

It is recognized that a substantial quantity of thermal energy is lost from residential furnaces through failure to recover energy otherwise dissipated through the flue or chimney. The amount of such excess losses will, of course, be variable and substantially unique for each individual installation. Therefore, in order to design a system for extracting thermal energy from the flues conducting heated gases from combustion zones, a number of variables must be taken into consideration, including particularly the amount of energy which may be extracted from the flue in order to continue to maintain appropriate stack temperatures, and preventing build-up of condensation and possible freezing thereof. The apparatus of the present invention provides a means for controllably adjusting the amount of heat to be extracted from the flue gases consistent with the requirements of the furnace flue, stack or chimney, thereby permitting the extraction of that amount of thermal energy which is in excess of that which is required for maintaining the appropriate stack temperature.

SUMMARY OF THE INVENTION

Therefore, in accordance with the present invention, heat exchange means is provided for use in combination with a conventional furnace flue or the like which is adapted to conduct heated gases from a combustion zone into the atmosphere, wherein a casing means is provided which may be retrofit into an existing chimney or flue, and which contains a number of isolated chambers. Specifically, a heat exchange chamber is disposed within the casing, with the heat exchange chamber being arranged between opposed inlet and outlet fresh air chambers. Heat exchange conduits couple the opposed fresh air chambers about a generally annular zone spaced radially outwardly from the central axis of the casing, and radially inwardly from the casing sheel. A pair of relatively movable baffle plates are provided within the heat exchange chamber, with the baffle plates extending radially outwardly from the central axis to the annular zone occupied by the heat exchange conduits. The relative axial positions of the baffle plates defines the axial length of the heat exchange conduits exposed to heated flue gases between the inlet and outlet to the heat exchange chamber. In this fashion, the system may be tailored to extract only that amount of thermal energy from the system which is in excess of that required to maintain proper fuel or chimney temperature conditions.

Therefore, it is a primary object of the present invention to provide an improved heat exchange system which is designed for use in combination with flues for conducting heated gases from combustion zones, and for extracting excess thermal energy from the heated gases.

It is yet a further object of the present invention to provide a heat exchange means for use in combination with flue means conducting heated gases from a combustion zone, wherein the heat exchange means is designed to be adjusted to extract only that quantity of thermal energy which is in excess of that required to maintain proper flue temperature conditions.

It is yet a further object of the present invention to provide an improved heat exchange means for use in combination with flue means conducting heated gases from a combustion zone, wherein the heat exchange means includes a heat exchange chamber having means for adjustably positioning baffle elements therewithin so as to control the flow of the heated gases therethrough, thereby extracting only that amount of thermal energy which is in excess of that required to maintain proper flue temperature conditions.

Other and further objects of the present invention will become apparent to those skilled in the art upon a study of the following specification, appended claims, and accompanying drawings.

DESCRIPTION OF THE PREFERRED EMBODIMENT

Figure 1:
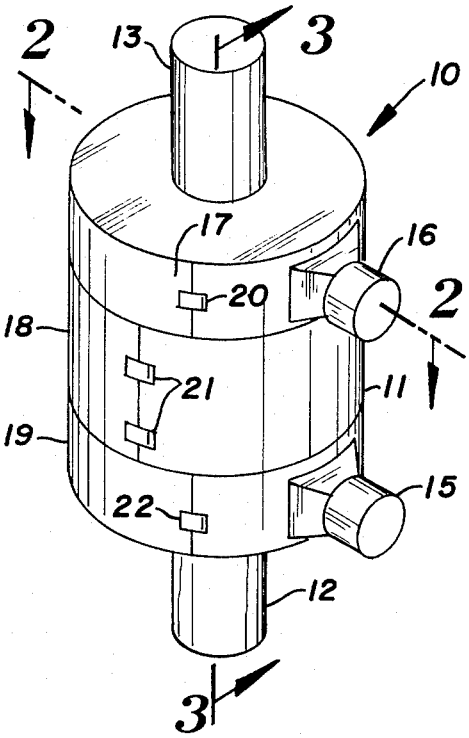
FIG. 1 is a perspective view showing one embodiment of the heat exchange means of the present invention, with the structure being shown as coupled to an existing flue installation.
Figure 2:
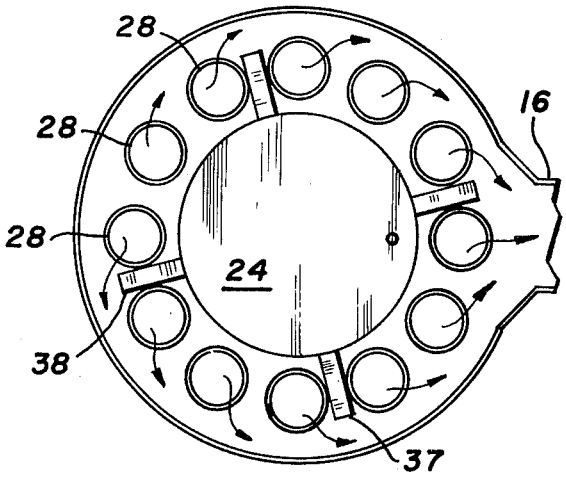
FIG. 2 is a horizontal sectional view taken along the line and in the direction of the arrows 2—2 of FIG. 1.
Figure 3:
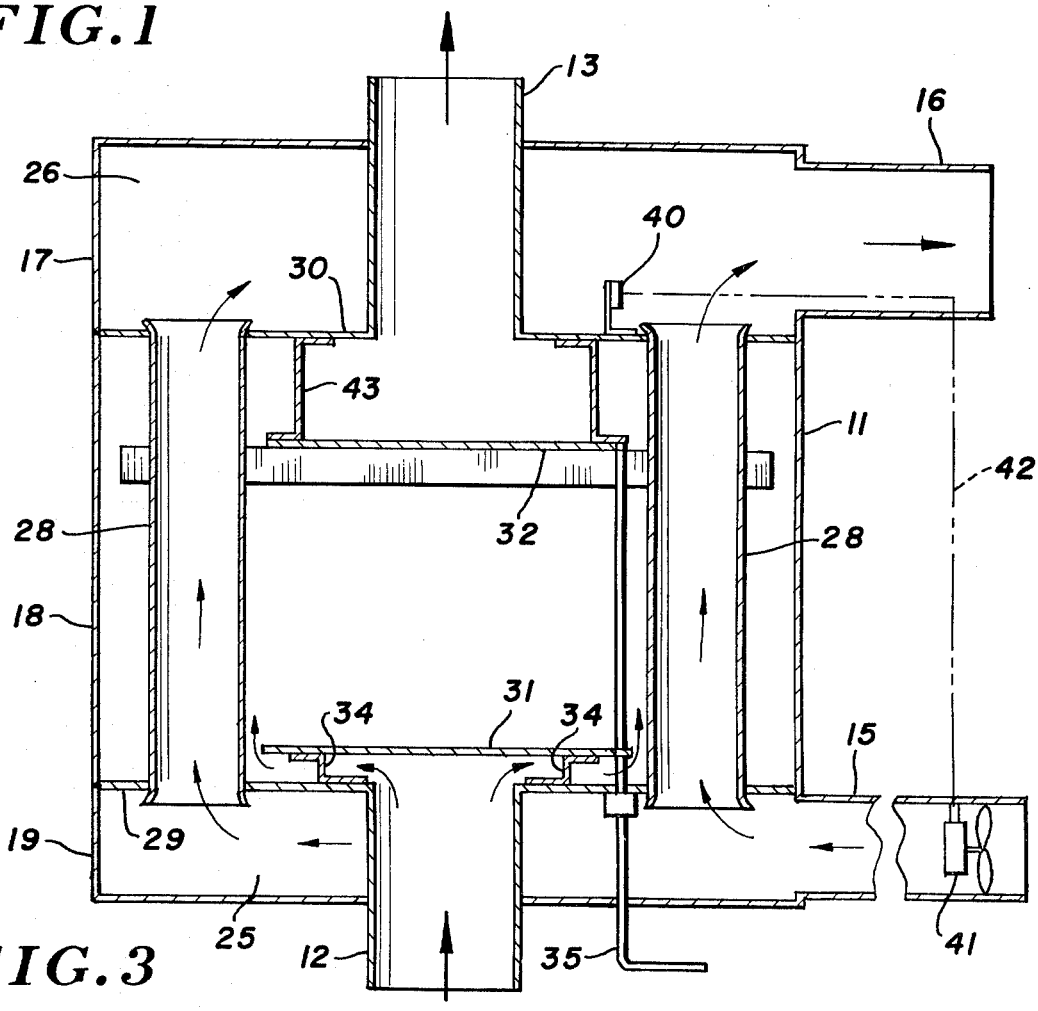
FIG. 3 is a vertical sectional view taken along the line and in the direction of the arrows 3—3 of FIG. 1.
Figure 5:
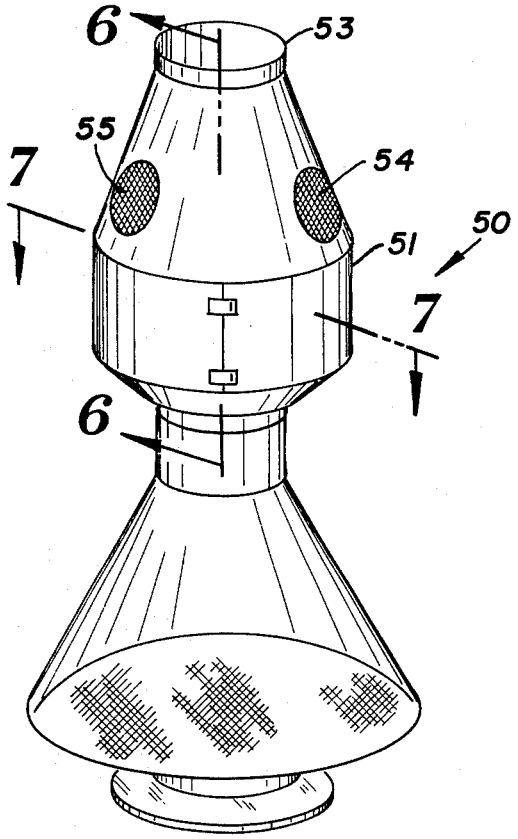
FIG. 5 is a perspective view of the modification of FIG. 4.
Figure 4:
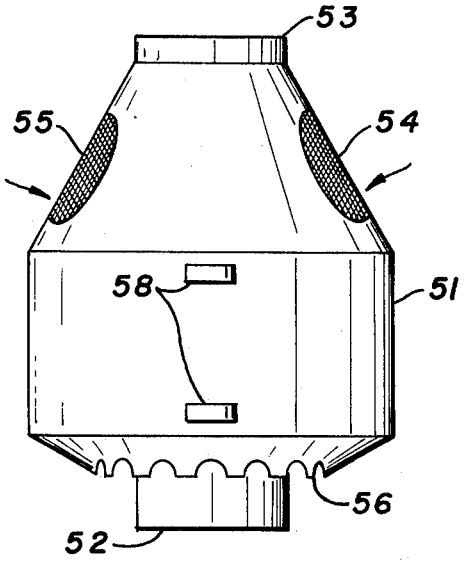
FIG. 4 is an elevational view of a modified form of heat exchange system in accordance with the present invention, with this modification being adapted for installation with a conventional fireplace.

In accordance with one preferred embodiment of the present invention, and with attention being directed to FIGS. 1-3 of the drawings, the heat exchange means generally designated 10 includes a casing means 11 having an inlet for bringing heated gases from a remote combustion zone (not shown) as at 12, and an outlet for these heated gases as at 13. The casing 11 is further provided with a fresh air inlet as at 15, and a fresh air outlet as at 16, for the purpose of conducting fresh air to be heated into the structure for the purpose of extracting excess thermal energy therefrom. For purposes of inspecting the unit, when desired, casing 11 is provided with a plurality of removable panels, such as panels 17, 18 and 19, with these panels being provided with conventional attaching straps at 20, 21 and 22. Panels 17, 18 and 19 may be removed in order to permit inspection or servicing of the system, as required.

Attention is now directed to FIGS. 2 and 3 of the drawings, wherein the heat exchange chamber is illustrated generally at 24, with this chamber being disposed between opposed fresh air inlet and outlet chambers 25 and 26 respectively. As previously indicated, inlet chamber 25 is in communication with inlet port 15, while outlet chamber 26 is in communication with outlet port 16.

Fresh air chambers 25 and 26 are coupled together by means of a plurality of heat exchange conduits such as conduits 28—28, with each such conduit being held within annular end plates 29 and 30. Suitable mounting techniques such as welding, rolling, or the like may be employed to secure the individual heat exchange conduits 28—28 within the opposed plates 29 and 30, as is indicated in FIG. 3 of the drawings. It will be further observed that heat exchange conduits 28—28 are arranged about a generally annular zone spaced radially outwardly from the central axis of the heat exchange chamber, and radially inwardly from the exterior wall 18 of the casing. The purpose of this disposition of the heat exchange conduits will be described more fully hereinafter.

With continued attention being directed to FIGS. 2 and 3, it will be observed that a pair of relatively movable baffle plates is provided within the heat exchange chamber 24, as at 31 and 32. Baffle 31 is fixed in position, mounted upon baffle support brackets 34—34, preferably in spider-like form, while baffle plate 32 is movable along the axis of the chamber, and generally at a position determined by baffle control arm 35. In the embodiment illustrated in FIGS. 1-3, baffle control arm 35, which is secured at its free end to baffle 32, may be withdrawn downwardly so as to move baffle 32 axially in a direction toward baffle plate 31. Radially extending guides, such as guides 37 and 38 may be employed to control the twisting motion or the like of plate 32.

The ultimate axial disposition of adjustable baffle defines the axial length of the heat exchange conduits which are exposed to the heated flue gases which are moving between the inlet and outlet. Baffle 31 forces the flue gases radially outwardly into contact with heat exchange conduits 28—28, and this contact is maintained in the zone separating baffles 31 and 32. Upon moving axially upwardly from the surface of baffle 32, the gases will move radially inwardly and ultimately outwardly of chamber 24 through outlet 13. In the disposition illustrated in FIG. 3, the maximum contact is experienced between the heated flue gases and the heat exchange conduits 28—28, and thus extract the maximum amount of thermal energy from the heated gases. As the baffle 32 is moved axially downwardly and toward the surface of baffle 31, the amount of energy extracted from the gases decreases proportionally.

In many installations, particularly in a forced hot air system, the main furnace fan may be employed to move fresh air through the heat exchange system. However, in certain installations, such as a gravity hot air system, or an in-story forced hot air system having a non-ducted heat requirement, an individual or independent fan unit may be employed for forced air circulation through the system. In such an arrangement, a thermostatically or condition responsive switching element such as element 40 may be employed to control the flow of electrical power to fan 41, such as is indicated in phantom in phantom coupling 42.

It has been indicated that baffle 31 is supported on brackets 34—34 and arranged in a spider-like fashion. The end adjacent the outlet for the flue gas is also provided with an adjustable stop member as at 43. In actual installations, the area available for flue gas flow is controlled so as to avoid the imposition of any restriction or impedance in the flue gas flow through the system. This is accomplished by ascertaining that the cross-sectional area available for flue gas flow through the heat exchange system is not provided with any constriction or restrictive portion.

In the embodiment illustrated in FIGS. 1-3, the system will function by gravity flow, with the hot air outlet being disposed adjacent the upper end of the system. As such, it is not absolutely required that a means be provided for forced air circulation therethrough, however it is more readily controllable and predictable when such a circulation means is provided.

The disposition of the movable baffle 32 may be determined by trial and error, particularly through the determination of the stack temperatures following installation of the unit. Since most installations will vary with their parameters, trial and error adjustment of the movable baffle should be undertaken prior to actually fixing the baffle in position. In certain installations, particularly in those installations where either conditions in the interior vary widely, or when outdoor conditions vary widely, it may be desirable to control the position of the baffle by virtue of a variable such as wind-chill conditions or the like. The system may be, in each instance, calibrated in accordance with the external wind-chill factor, particularly when the interior conditions remain substantially constant. A predetermined positioning of the movable baffle will, in each instance, provide adequate stack temperatures for prevailing conditions, thereby preventing build-up of condensation or freezing of condensation which could otherwise occur in the stack or chimney.

With continued attention being directed to the embodiment illustrated in FIGS. 1-3, it will be appreciated that the outlet 16 may, in certain installations, be coupled directly to the return plenum of the existing system, thereby providing a simple and controllable way of utilizing the thermal energy in the system. It will be appreciated that outlet 16 could, in other considerations and installations, be directed to any individual room or area normally serviced by the existing furnace, the combustion zone of the furnace providing heat gases for the device.

Attention is now directed to the embodiment illustrated in FIGS. 4-7 inclusive, wherein the heat exchange means generally designated 50 is provided with a casing 51 having an inlet 52 and an outlet 53. Inlet 52 is designed for coupling to the outlets from a fireplace, particularly a fireplace of the free-standing variety which are commercially available. Heat exchange means 50 is adapted to extract thermal energy from the stack of the free-standing fireplace.

A pair of fresh air inlets are provided at 54 and 55, with a plurality of outlets being provided, as illustrated at 56. Casing 521 is adapted for removable securing to the frame means of the structure, such as by strap elements 58—58.

Figure 6:
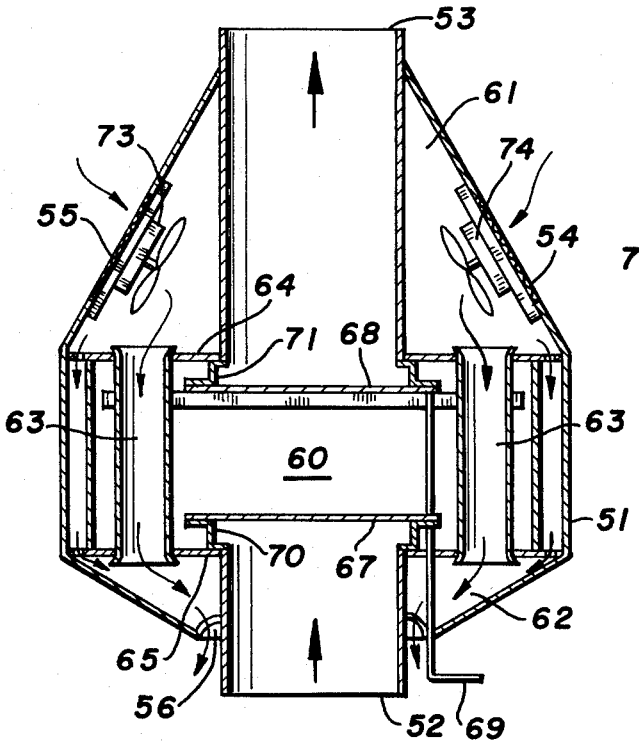
FIG. 6 is a vertical sectional view taken along the line and in the direction of the arrows 6—6 of FIG. 5.
Figure 7:
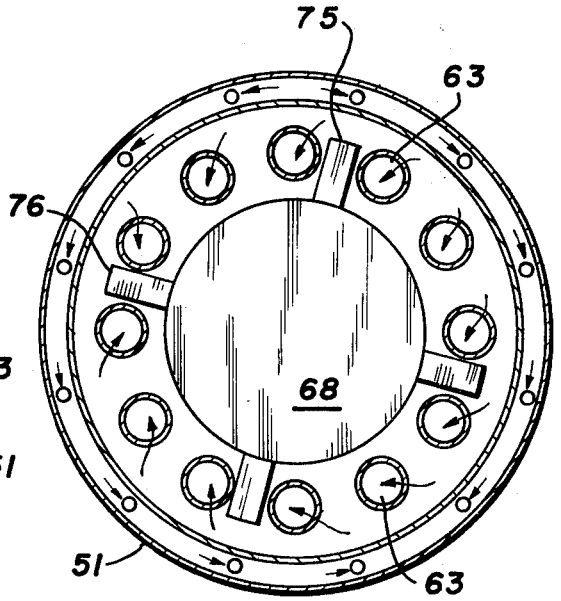
FIG. 7 is a horizontal sectional view taken along the line and in the direction of the arrows 7—7 of FIG. 5.

With attention now being directed to FIGS. 6 and 7 of the drawings, it will be noted that the hot flue gases pass through the system so as to move generally through a heat exchange chamber generally designated 60. On opposite sides of the chamber 60 are fresh air inlet and outlet chambers 61 and 62 respectively. A plurality of individual heat exchange conduits 63—63 are interposed between chambers 61 and 62, and are secured in place in annular plates 64 and 65. It will be observed that the disposition of the heat exchange conduits 63—63 is about a generally annular zone spaced radially outwardly from the central axis of the heat exchange chamber, and radially inwardly from the surface of casing 51. This arrangement provides for a flow pattern for the heated gases about the periphery of the heat exchange conduits 63—63.

A pair of relatively movable baffles are provided as at 67 and 68, with baffle 68 being movable axially and controllably throught baffle control element or handle 69. The disposition of baffle 67 is fixed by means of the support brackets 70—70, and the axial movement of baffle 68 away from baffle 67 is controlled to its extreme extent by stop element 71. Stop 71 may also be in the form of brackets arranged in a spider-like fashion as are brackets 70—70.

In order to move fresh air through the system, a pair of fan motors are provided as at 73 and 74, with these fans driving fresh air downwardly through the system, thereby disposing the hot air outlet more closely adjacent the floor, and achieving a greater degree of flow of heated fresh air throughout the ambience.

Also, baffle guides are provided as at 75–76 in order to control, restrict, or otherwise achieve motion of baffle 68 relative to baffle 67.

The purpose of the movable baffle is the same as that shown in the embodiment of FIGS. 1–3.

For material or construction, conventional stack materials 20 may be employed advantageously. There is, of course, no unusual materials requirement in this apparatus.

I claim:

1. Heat exchange means for use in combination with flue means conducted heated gases from a combustion zone and for extracting thermal energy therefrom; said means comprising:

a. casing means defining a enclosure with a central axis and having a first inlet and a first outlet generally concentric with said central axis for transmission of hot flue gas therethrough, and a second inlet and a second outlet for the transmission therethrough of fresh air to be heated, and fresh air inlet and outlet chambers at opposed ends of said casing and adjacent said second inlet and outlet respectively;

b. a heat exchange chamber therein and disposed between said opposed inlet and outlet chambers and having heat exchange conduits coupling said fresh air inlet chamber to said fresh air outlet chamber and extending through said heat exchange chamber about a generally annular zone spaced radially outwardly from the central axis of said heat exchange chamber, and radially inwardly from said casing means;

c. a pair of relatively movable baffle plates disposed within said heat exchange at opposed ends thereof and including a fixed baffle plate and a movable baffle plate with each of said baffle plates being disposed within said heat exchange chamber between said first inlet and first outlet and extending radially outwardly from said central axis to said annular zone for controlling the flow of hot flue gas out said heat exchange conduits, and radially outwardly of said annular zone;

d. baffle adjustment means for controllably positioning said movable baffle plate axially within said heat exchange chamber to define the axial length of said heat exchange conduits exposed to said heated flue gas between said heat exchange chamber inlet and said movable baffle.

2. The heat exchange means as defined in claim 1 being particularly characterized in that said casing includes an outer protective shroud.

3. The heat exchange means as defined in claim 1 being particularly characterized in that guide means are secured to said movable baffle for resisting arcuate motion thereof.

4. The heat exchange means as defined in claim 1 being particularly characterized in that the cross-sectional area about the outer periphery of each of said baffle plates is at least equal to the cross-sectional area of said first inlet and outlet.

* * * * *

UNITED STATES PATENT OFFICE
CERTIFICATE OF CORRECTION

PATENT NO. : 4,050,627

DATED : September 27, 1977

INVENTOR(S) : Joseph E. Mayer

It is certified that error appears in the above-identified patent and that said Letters Patent are hereby corrected as shown below:

Column 2, line 12, "fuel" should read -- flue --.

Column 4, line 58, "heat" should read -- heated --.

Column 5, line 44, "20" should be deleted.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*